US009385500B2

(12) United States Patent
Goossens

(10) Patent No.: US 9,385,500 B2
(45) Date of Patent: Jul. 5, 2016

(54) ELECTRICAL CONNECTOR INCLUDING FINS

(71) Applicant: Thierry Goossens, Herdersem-Aalst (BE)

(72) Inventor: Thierry Goossens, Herdersem-Aalst (BE)

(73) Assignee: FCI ASIA PTE. LTD., Singapore (SG)

( * ) Notice: Subject to any disclaimer, the term of this patent is extended or adjusted under 35 U.S.C. 154(b) by 29 days.

(21) Appl. No.: 14/463,792

(22) Filed: Aug. 20, 2014

(65) Prior Publication Data

US 2015/0056868 A1 Feb. 26, 2015

Related U.S. Application Data

(60) Provisional application No. 61/870,030, filed on Aug. 26, 2013.

(51) Int. Cl.

| | |
|---|---|
| ***H01R 13/73*** | (2006.01) |
| ***H01R 43/26*** | (2006.01) |
| ***H01R 12/72*** | (2011.01) |
| *H01R 107/00* | (2006.01) |

(52) U.S. Cl.

CPC ..... *H01R 43/26* (2013.01); *H01R 12/724* (2013.01); *H01R 2107/00* (2013.01)

(58) Field of Classification Search

CPC ..... H01R 13/73

USPC ..... 439/79, 572, 947, 934

See application file for complete search history.

(56) References Cited

U.S. PATENT DOCUMENTS

| | | | | |
|---|---|---|---|---|
| 5,158,471 | A * | 10/1992 | Fedder | H01R 9/091 439/65 |
| 5,928,035 | A | 7/1999 | Jankowsky | |
| 6,299,480 | B1 | 10/2001 | Xu et al. | |
| 6,354,875 | B1 | 3/2002 | Wu | |
| 6,498,708 | B2 | 12/2002 | Schilloff et al. | |
| 6,563,056 | B1 | 5/2003 | Belwon et al. | |
| 6,733,301 | B2 * | 5/2004 | Brown, III | H01R 12/585 439/65 |
| 6,780,054 | B2 | 8/2004 | Yip et al. | |
| 7,139,177 | B2 | 11/2006 | Gottlieb | |
| 7,314,377 | B2 * | 1/2008 | Northey | H01R 12/777 439/79 |
| 7,344,395 | B2 | 3/2008 | Agethen et al. | |
| 7,497,731 | B2 | 3/2009 | Rosenfeldt et al. | |
| 7,666,025 | B2 * | 2/2010 | Cheng | H01R 12/7088 439/374 |
| 7,976,317 | B2 | 7/2011 | Patel et al. | |
| 2011/0111608 | A1 | 5/2011 | Chen et al. | |
| 2011/0281462 | A1 | 11/2011 | Tonosaki | |
| 2012/0262895 | A1 | 10/2012 | Quek | |

* cited by examiner

*Primary Examiner* — Phuong Dinh

(74) *Attorney, Agent, or Firm* — Baker & Hostetler LLP

(57) ABSTRACT

An electrical connector can be configured to mate with at least one complementary electrical connector. The electrical connector includes a dielectric connector housing including a housing body that defines a mounting interface configured to be mounted onto a substrate and a mating interface configured to receive at least one complementary electrical connector along a mating direction. A plurality of electrical contacts are supported by the connector housing and spaced apart from each other along a lateral direction that is substantially perpendicular to the mating direction. The electrical contacts include 1) a mating portion that is configured to mate with a complementary electrical contact of the complementary electrical connector, and 2) a mounting portion configured to electrically connect to the substrate. The electrical connector can further include at least one electrically insulative fin supported by the housing body.

24 Claims, 13 Drawing Sheets

ELECTRICAL CONNECTOR INCLUDING FINS

CROSS REFERENCE TO RELATED APPLICATIONS

This Application claims the benefit of U.S. Provisional Patent Application Ser. No. 61/870,030, filed Aug. 26, 2013, the disclosure of which is hereby incorporated by reference as if set forth in its entirety herein.

BACKGROUND

Electrical connectors used to transmit data signals and/or electrical power, such as alternating current (AC) power and/or direct current (DC) power, may include a plurality of power contacts and a plurality of signal contacts mounted in an electrically insulative housing. In a typical application, the connector may be configured to be mounted onto a substrate, such as a printed circuit board, and configured to mate with a complementary electrical component, which can be a power cable or complementary electrical connector, for example. Specifically, each contact within the housing may include one or more header and/or receptacle contacts that mate with opposed receptacle and/or header contacts, respectively, of the complementary electrical component.

A typical contact includes multiple terminals or pins extending from a bottom portion for electrically connecting the contact to a substrate, such as a printed circuit board. In the case of power contacts, high voltage levels traveling through the terminals can produce arcing across the terminals, which can also be referred to as leaking or creeping. It is known, therefore, that under otherwise constant conditions, for instance the same substrate material and the number of terminals, spacing the terminals away from each other can reduce the instances of arcing. However, spacing the terminals farther apart while maintaining the number of terminals adds to the overall footprint of the connector, thereby occupying valuable space on the circuit board.

SUMMARY

In accordance with one embodiment, an electrical connector is configured to mate with at least one complementary electrical connector. The electrical connector includes a dielectric connector housing including a housing body that defines a mounting interface configured to be mounted onto a substrate and a mating interface configured to mate with at least one complementary electrical connector along a mating direction. A plurality of electrical contacts are supported by the connector housing and spaced apart from each other along a lateral direction that is substantially perpendicular to the mating direction. The electrical contacts include 1) a mating portion that is configured to mate with a complementary electrical contact of the complementary electrical connector, and 2) a mounting portion configured to electrically connect to the substrate. The electrical connector can further include at least one electrically insulative fin supported by the housing body. The fin can be disposed between first and second electrical contacts of the plurality of electrical contacts along the lateral direction. The mounting portion of each of the first and second electrical contacts can terminate at a mounting end that is spaced from the housing body a first distance along the transverse direction that is perpendicular to each of the mating direction and the lateral direction. The at least one fin can extend from the housing body along the transverse direction and can terminate at a distal end that is spaced from the housing body a second distance along the transverse direction, wherein the second distance is no less than the first distance.

DETAILED DESCRIPTION

Figure 1A:
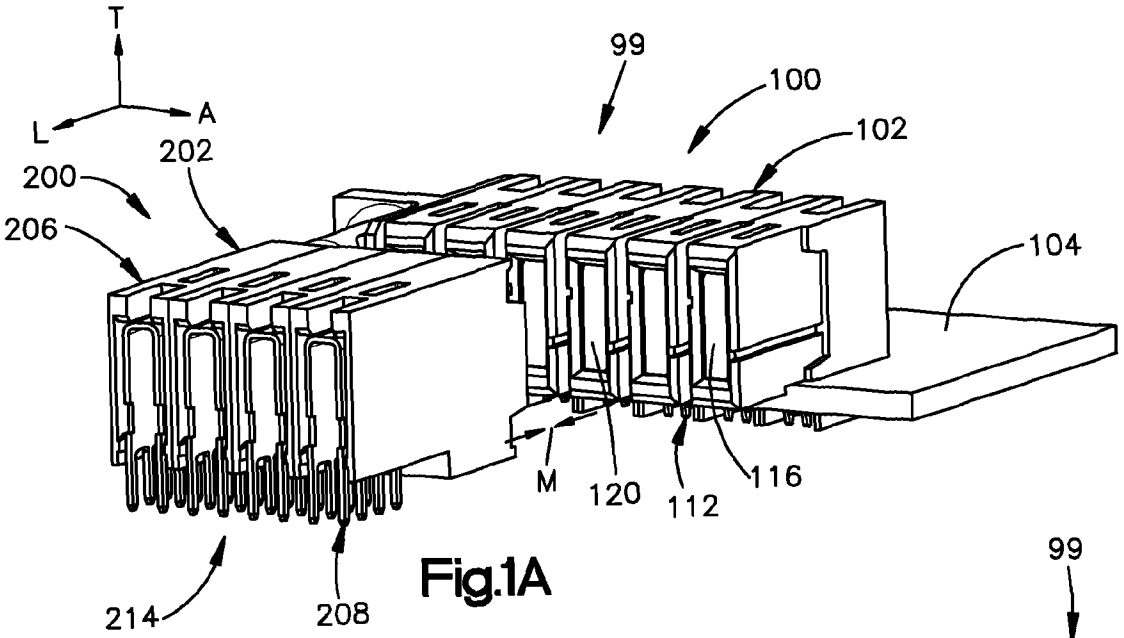
FIG. 1A is a perspective view of an electrical connector system constructed in accordance with one embodiment including an electrical connector assembly that includes an electrical connector mounted to an underlying substrate, wherein the electrical connector assembly is aligned for mating with a complementary electrical connector.

For convenience, the same or equivalent elements in the various embodiments illustrated in the drawings have been identified with the same reference numerals. Certain terminology is used in the following description for convenience only and is not limiting. The words "left," "right," "front," "rear," "upper," and "lower" designate directions in the drawings to which reference is made. The words "forward," "forwardly," "rearward," "inner," "inward," "inwardly," "outer," "outward," "outwardly," "upward," "upwardly," "downward," and "downwardly" refer to directions toward and away from, respectively, the geometric center of the object referred to and designated parts thereof. The terminology intended to be non-limiting includes the above-listed words, derivatives thereof and words of similar import.

Figure 1B:
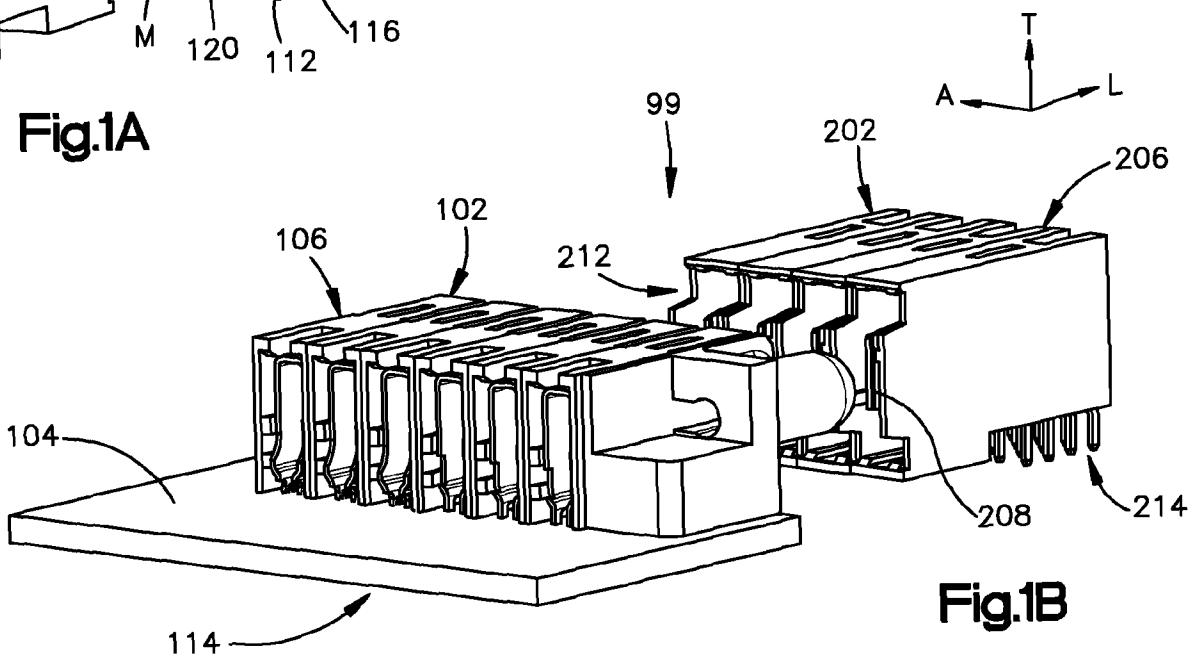
FIG. 1B is another perspective view of the electrical connector system shown in FIG. 1A.

Referring initially to FIGS. 1A-B, in accordance with one embodiment, an electrical connector system 99 can include a first electrical connector assembly 100 and a second or complementary electrical connector assembly 200. The electrical connector assembly 100 can include a first electrical connector 102 and a first electrical component such as a first substrate 104, and the complementary electrical assembly 200 can include a second or complementary electrical connector 202 and a second electrical component such as a second or complementary substrate. The electrical connectors 102 and 202 can be configured to be mated with each other so as to establish an electrical connection, for instance an electrical connection that transfers power, between the electrical connectors 102 and 202, and thus between the first and complementary electrical assemblies 100 and 200, respectively. The electrical connector 102 can be configured to be mounted to the substrate 104 and the complementary electrical connector 202 can be configured to be mounted to the complementary substrate so as to establish an electrical connection between the substrates. The substrates can be provided as a backplane, midplane, daughtercard, or the like.

Referring also to FIGS. 2A-D, the electrical connector 102 can include a first dielectric or electrically insulative connector housing 106 and at least one such as a plurality of electrical contacts 108 that are at least partially disposed within the connector housing 106. The electrical contacts 108 can include power contacts that are configured to transmit electrical current. The electrical contacts 108 can include signal contacts that are configured to transmit data. In accordance with the illustrated embodiment, when the electrical connector 102 is mounted to the substrate 104 along a mounting direction, the electrical contacts 108 are placed in electrical communication with electrical traces of the substrate 104. The complementary electrical connector 202 can include a second or complementary dielectric or electrically insulative connector housing 206 and at least one such as a plurality of complementary electrical contacts 208 that are supported by the complementary connector housing 206. When the complementary electrical connector 202 is mounted to the complementary substrate, the electrical contacts 208 are placed in electrical communication with electrical traces of the complementary substrate. The electrical connector 102 can be configured to mate with the complementary electrical connector 202 along a mating direction M so as to establish an electrical connection between the first and second electrical contacts 108 and 208, respectively, and thus also between the electrical traces of the substrate 104 and the complementary substrate. The plurality of electrical contacts 108 can be supported by the connector housing 106 and spaced apart from each other along a lateral direction A that is substantially perpendicular to the mating direction M.

Referring also to reference to FIGS. 3A-4B, in accordance with the illustrated embodiment, the electrical connector 102 can be constructed as a right-angle receptacle connector that includes the connector housing 106. The connector housing 106 includes a first housing body 110 that defines a first mating interface 112 and a first mounting interface 114 which are oriented substantially perpendicular with respect to each other so as to define the right-angle electrical connector 102. It will be understood that the electrical connector 102 can be constructed as desired, for instance as a vertical connector such that the mating interface 112 is parallel with respect to the mounting interface 114. The mounting interface 114 can be configured to be mounted onto a substrate and the mating interface 112 can be configured to mate with at least one complementary electrical connector along the mating direction M.

In accordance with the illustrated embodiment, the complementary electrical connector 202 can be constructed as a right-angle header connector that defines a second or complementary mating interface 212 and a second or complementary mounting interface 214 that extends substantially perpendicular to the complementary mating interface 212. The mating interface 112 of the electrical connector 102 can be configured to mate with the complementary mating interface 212 of the complementary electrical connector 202. The first and complementary mounting interfaces 114 and 214, respectively, can be configured to mount onto underlying substrates, such as the substrate 104 and the complementary substrate. The mating interface 112 of the electrical connector 102 can include receptacle openings 116 that are defined by the connector housing 106, such that the complementary electrical contacts 208 of the complementary electrical connector 202 can be received in the receptacle openings 116 when the electrical connector 102 is mated with the complementary electrical connector 202.

As shown in the illustrated embodiment, the electrical connector 102 can be configured as a receptacle connector and the complementary electrical connector 202 can be configured as a header connector, such that the connector housing 106 is configured to receive the complementary connector housing 206 so as to mate the first and complementary electrical connectors 102 and 202, respectively.

Various structures are described herein as extending horizontally along a first or longitudinal direction "L" and a second or lateral direction "A" that is substantially perpendicular to the longitudinal direction L, and vertically along a third or transverse direction "T" that is substantially perpendicular to the longitudinal and lateral directions L and A, respectively. As illustrated, the longitudinal direction "L" extends along a forward/rearward direction of the electrical connector 102, and defines the mating direction M along which one or both of the electrical connector 102 and the complementary electrical connector 202 are moved relative to the other so as to mate the electrical connector assembly 100 with the complementary electrical connector assembly 200, and thus to mate the electrical connector 102 with the complementary electrical connector 202. For instance, the mating direction M of the illustrated electrical connector 102 is in a forward direction along the longitudinal direction L, and the electrical connector 102 can be unmated from the complementary electrical connector 202 by moving the electrical connector 102 in an opposed longitudinally rearward direction relative to the complementary electrical connector 202. As illustrated, the electrical connector 102 can be moved relative to the substrate 104 along the transverse direction T that defines the mounting direction, and the lateral direction "A" extends along a width of the electrical connector 102.

Thus, unless otherwise specified herein, the terms "lateral," "longitudinal," and "transverse" are used to describe the orthogonal directional components of various components. The terms "inboard" and "inner," and "outboard" and "outer" and like terms when used with respect to a specified directional component are intended to refer to directions along the directional component toward and away from the center of the apparatus being described. It should be appreciated that while the longitudinal and lateral directions are illustrated as extending along a horizontal plane, and that while the transverse direction is illustrated as extending along a vertical plane, the planes that encompass the various directions may differ during use, depending, for instance, on the orientation of the various components. Accordingly, the directional terms "vertical" and "horizontal" are used to describe the electrical connector assembly 100 and its components as illustrated merely for the purposes of clarity and convenience, it being appreciated that these orientations may change during use.

With continuing reference to FIGS. 1-4B, in accordance with the illustrated embodiment, the housing body 110, and thus the connector housing 106, defines a front end 110*a* and an opposed rear end 110*b* that is spaced from the front end 110*a* along the longitudinal direction L. The front end 110*a* can generally lie in a plane defined by the transverse and lateral directions T and A, respectively. The front end 110*a* can define the mating interface 112 that is configured to be mated with the complementary electrical connector 202 so as to place the electrical connector 102 in electrical communication with the complementary electrical connector 202. The housing body 110, and thus the connector housing 106, can further include a top end 110*c* and an opposed bottom end 110*d* that is spaced from the top end 110*c* along the transverse direction T. For instance, the top end 110*c* can be spaced from the bottom end 110*d* in an upward direction that is substantially parallel to the transverse direction T. Thus, the bottom end 110*d* can be spaced from the top end 110*c* in a downward direction that is substantially parallel to the transverse direction T. The top end 110*c* can extend from the front end 110*a* to the rear end 110*b*. The bottom end 110*d* can define the mounting interface 114 that is configured to be mounted to the substrate 104. The bottom end 110*d* can generally lie in a plane defined by the longitudinal and lateral directions L and A, respectively. The connector housing 106, and thus the electrical connector 102, can further include first and second opposed sides 110*e* and 110*f*, respectively, that are spaced from each other along the lateral direction A. While the lateral and longitudinal directions A and L, respectively, extend horizontally and the transverse direction T extends vertically in accordance with the illustrated orientation of the electrical connector assembly 100, it should be appreciated that the orientation of the electrical connector assembly can vary as desired.

Figure 3A:
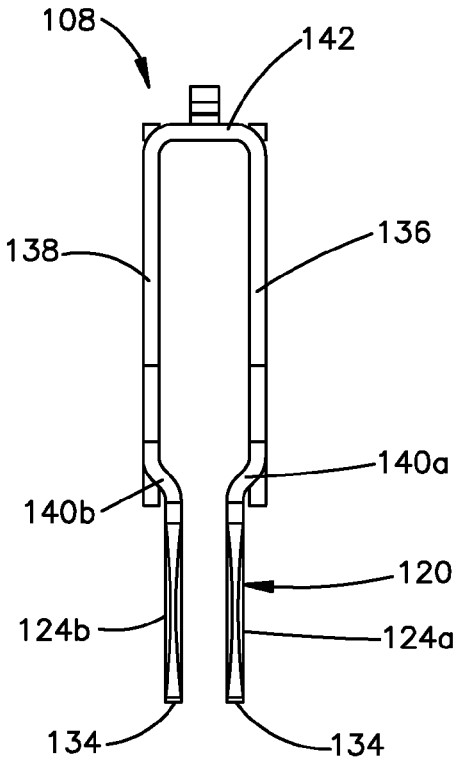
FIG. 3A is an isolated rear elevation view of one electrical contact of the plurality of electrical contacts shown in FIG. 2A.
Figure 3B:
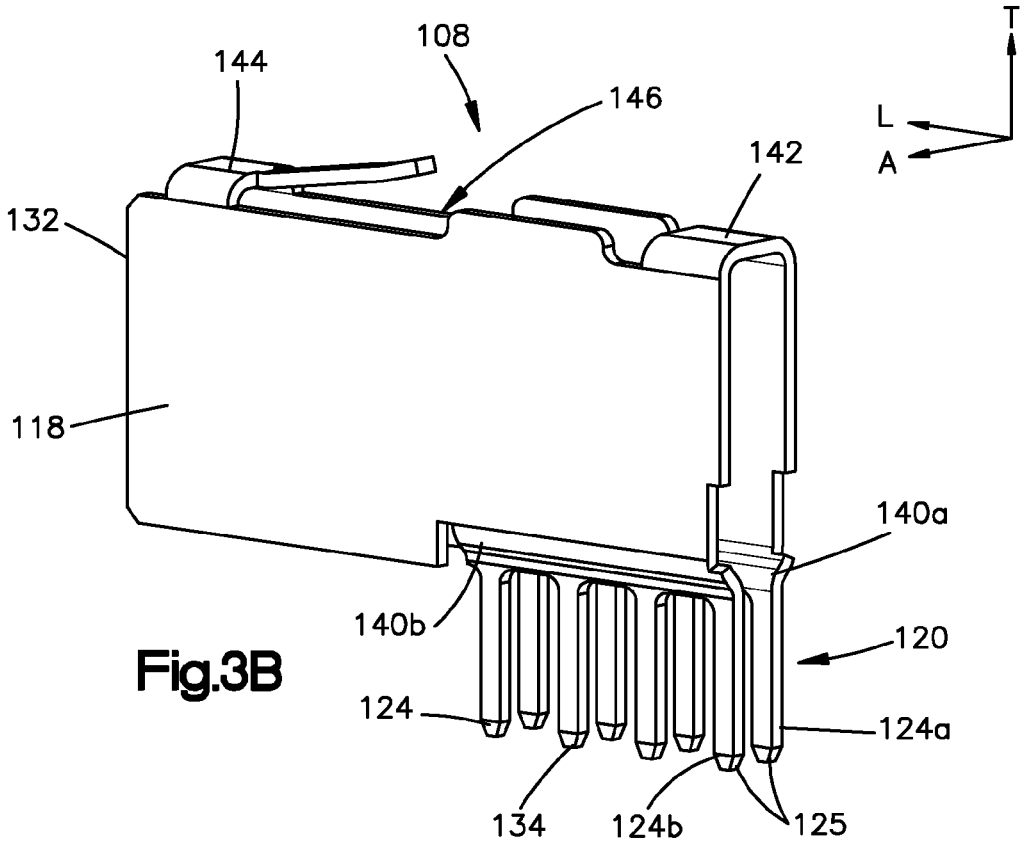
FIG. 3B is a perspective view of another embodiment of the electrical contact shown in FIG. 3A.
Figure 3C:
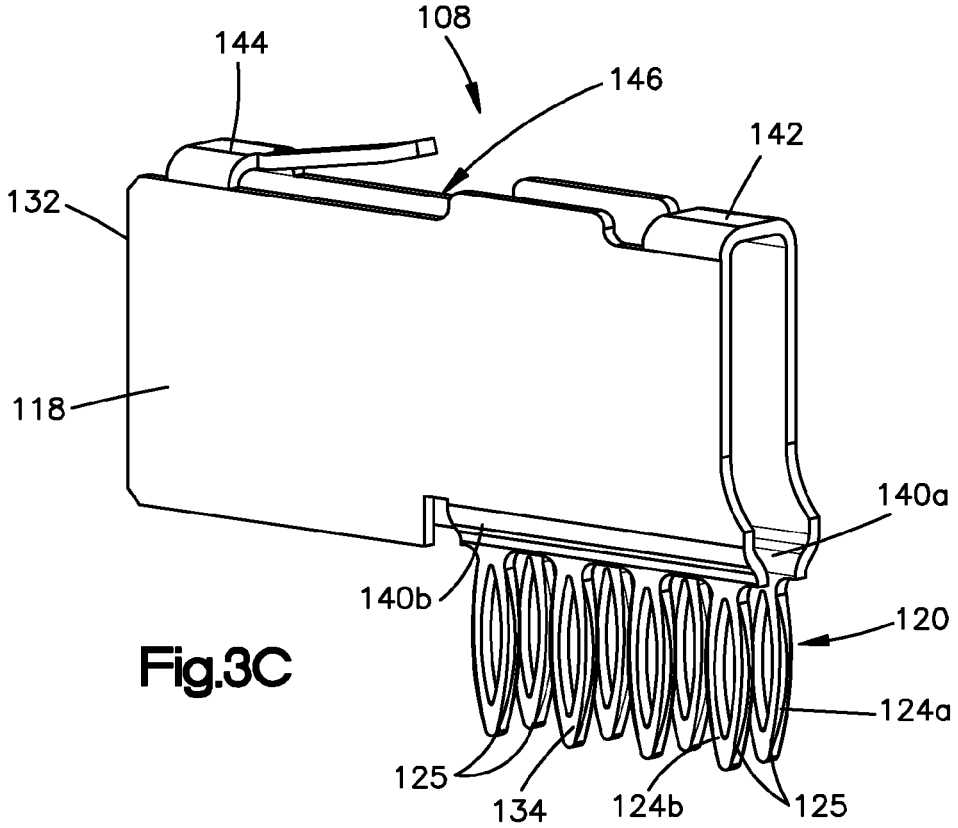
FIG. 3C is a perspective view of the electrical contact shown in FIG. 3A.

Referring to FIGS. 3A-C, the electrical contacts 108 can each define a mating portion 118, a mounting portion 120, and an intermediate portion 122 that extends between the mating portion 118 and the mounting portion 120. The mating portions 118 can be configured to mate with the complementary electrical contacts 208 of the complementary electrical connector 202 that is to be mated with the electrical connector 102. Thus, the mating portion 118 can be configured to mate with a complementary electrical contact of at least one complementary electrical connector when the connector housing 106 is mated with the at least one complementary electrical connector.

The mounting portions 120 can be configured to electrically connect to the substrate 104 when the connector housing 106 is mounted onto the substrate 104. The mounting portion 120 can include one or more mounting terminals 124 that are disclosed proximate to the mounting interface 114 and are configured to electrical connect to the substrate 104. In one embodiment, the mounting terminals 124 are inserted through plated through-holes 126 of the substrate 104 and the mounting terminals 124 define press-fit tails. The through-holes 126 can define mounting locations 128 that define a footprint constructed as described with respect to the footprint 130 described below with respect to FIG. 5-6. Alternatively, the mounting terminals 124 can be surface-mounted to the substrate 104. The mounting terminals 124 can further be soldered to the substrate 104 as desired. Thus, the electrical contacts 108 can place the substrate 104 in electrical communication with the complementary electrical connector 202 when the complementary electrical connector 202 is mated with the electrical connector assembly 100. The electrical contacts 108 can be configured as power contacts that transmit electrical power between the substrate 104 and a complementary electrical component such as the electrical connector 202. Thus, the electrical connector 102 can be configured as a power connector.

In accordance with the illustrated embodiment, the mating portion 118 extends forward from the intermediate portion 122 along the longitudinal direction L and terminates at a mating end 132, and the mounting terminals 124 extend downward from the intermediate portion 122 along the transverse direction and terminate at a mounting end 134. The mounting ends 134 can be configured to be placed in electrical communication with the substrate 104 when the mounting interface 114 is mounted to the substrate 104. The illustrated mating portions 118 extend in a direction substantially perpendicular to the mounting terminals 124 such that the electrical contacts 108 can be referred to as right-angle contacts. Alternatively, the electrical contacts 108 can be constructed as a "vertical" or "mezzanine" arrangement whereby the mating portions 118 extend in a direction parallel to the mounting terminals 124.

Because the mating ends 132 of the electrical contacts 108 are configured to receive their complementary contacts 208, they can be referred to as "receptacle" contacts, and the electrical connector 102 can be referred to as a "receptacle" connector.

Referring to FIGS. 3A-C and 7A-8B, each of the electrical contacts 108 includes a first side wall 136 and a second side wall 138 that is spaced from the first side wall 136 along the lateral direction A so as to define a distance, which can be referred to as a third distance $d_3$. The mounting portion 120 of each electrical contact 108 includes at least one pair 125 of mounting terminals 124. The mounting terminals 124 in each pair 125 are aligned with each along the longitudinal direction L, and spaced from each other along the lateral direction A. The mounting portion 120 further defines at least one neck, for instance first and second necks 140*a* and 140*b*, that extend between the first and second side walls 136 and 138, respectively, and first and second pluralities of mounting terminals 124*a* and 124*b*, respectively. Thus, each pair 125 of mounting terminals 124 includes a first mounting terminal 124*a* and a second mounting terminal 124*b*. The first and second necks 140*a* and 140*b* can be curved or angled inward along the downwardly transverse direction T such that the first and second mounting terminals 124*a* and 124*b* in each pair 125 are spaced apart from each other a shorter distance along the lateral direction A than the first and second side walls 136 and 138 are spaced from each other along the lateral direction A. For instance, the electrical contact 108 can include first and second pluralities of mounting terminals 124*a* and 124*b* can be spaced apart from each along the lateral direction A to define a distance, which can be referred to as a fourth distance $d_4$, that is less than the third distance $d_3$. The electrical contact 108 can further include the first neck 140*a* that extends between the first side wall 136 and the first plurality of mounting terminals 124*a*, and the second neck 140*b* that extends between the second side wall 138 and the second plurality of mounting terminals 124*b*.

The mounting terminals 124 can define through-hole, solder-to-board pins (as shown in FIG. 3B), press fit pins (as shown in FIG. 3C) or surface mount tails, or any suitable alternative structure configured to electrically connect to the substrate 104. The first and second side walls 136 and 138 can be connected by one or more bridge elements, for instance a first bridge element 142 and a second bridge element elements 144, and thus electrical contacts 108 can each be U-shaped, although it will be understood that the electrical contacts 108 can be alternatively shaped as desired. A medial space 146, for instance adapted for air flow, can be defined between the first and second side walls 136 and 138, respectively. It will be understood that the electrical contact 108 can be stamped or otherwise formed as a single piece from a strip of suitable contact materials such as phosphor bronze alloys, beryllium copper alloys, or any suitable alternative electrically conductive material.

The housing body 110, and thus the connector housing 106, can define receptacle openings 116 that are configured to receive at least one electrically conductive component along the longitudinal direction L, which can be referred to as the mating direction M. The openings 116 can be disposed at the front end 110*a*. The electrical contacts 108 can be supported by the connector housing 106 and can be configured to contact the complementary electrical contacts 208 when the complementary electrical connector 202 is received in the openings 116. In accordance with the illustrated embodiment, the receptacle openings 116 are disposed at the front end 110*a* of the connector housing 106, thus the front end 110*a* of the connector housing can define the openings 116. The connector housing can further define first and second electrically insulative arms 150*a* and 150*b* that are spaced apart from each other along the lateral direction A and that are supported by the housing body 110. The first and second arms 150*a* and 150*b* can abut the first and second side walls 136 and 138, respectively, such that the first and second side walls 136 and 138 are at least partially disposed within the receptacle opening 116. Thus, the first and second arms 150*a* and 150*b* can further define the receptacle opening 116. In particular, the mating portion 118 of each electrical contact 108 can be disposed within the opening 116 such that the mating portion 118 contacts the complementary electrical contact 208 when the complementary electrical connector 202 is received in the receptacle opening 116. The arms 150*a* and 150*b* can extend from the housing body 110 forwardly along the longitudinal direction L. Alternatively, the arms 150*a* and 150*b* can be monolithic with the housing body 110.

The first arm 150*a* can define a first arm body 153*a* and a first barb 151*a* that extends along the lateral direction A from the arm body 153*a* so as to be disposed in front of the mating end 132 along the longitudinal direction L. Similarly, the second arm 150*b* can define a second arm body 153*b* and a second barb 153*b* that extends along the lateral direction A from the arm body 153*b* so as to be disposed in front of the mating end 132 along the longitudinal direction L. Thus, the barbs 151*a* and 151*b* can be disposed at the front end 110*a* of the connector housing 106, and barbs 151*a* and 151*b* can contact the mating end 132 along the lateral direction A such that the mating ends 132 are touch proof, and thus the mating ends 132 are blocked from human contact or humans are otherwise prevented from touching the mating ends 132 with their fingers. As used herein, touch-proof can also refer to compliance with a standardized test that is published in IEC 60950, which verifies that contact parts, such as mating ends or mounting ends, cannot be touched by a test finger. Thus, the mating ends 132 can be touch-proof such that the mating ends 132 cannot be touched by a test finger, which represents a human finger, from every reasonable position. Further, at least one arm, for instance the first and second arms 150*a* and 150*b*, can be supported by the housing body 110. The at least one arm can extend beyond the mating portions 118 in the mating direction M such that the mating portions 118 terminate at a location 152 along the mating direction M that is disposed inward with respect to a location 154 in which the arm terminates along the mating direction M.

With particular reference to FIGS. 7A-8B, a first arm 150*a* that abuts a first electrical contact 108 can be spaced from a second arm 150*b* that abuts a second electrical contact 108 along the lateral direction so as to define a gap 160. The gap 160 can be configured to receive a portion of the complementary connector housing 206 when the electrical connector 102 is mated with the complementary electrical connector 202. For instance, the complementary connector housing 206 can define a wall 222 that extends beyond the complementary electrical contacts 208 along the mating direction M such that the complementary contacts are touch proof, and the wall 222 can be received by the gap 160 so that the complementary electrical contacts 208 can electrically connect to the electrical contacts 108 when the electrical connector 102 is mated with the complementary electrical connector 202. Thus, the complementary connector housing 206 can be received in the gap 160 that extends into the housing body 106.

Thus, the connector housing 106 can include an inner surface 107 that defines at least one opening 116 such that at least one of the plurality of electrical contacts 108 are disposed in the opening. The inner surface 107 can at least substantially surround the at least one of the plurality of electrical contacts 108, and the inner surface 107 can extend out from the housing body 110 along the mating direction M past the mating end 132 of the at least one of the plurality of electrical contacts 108, wherein at least one of the electrical contacts terminates at the mating end 132. Thus, the electrical contacts 108, and thus the electrical connector 102, can be touch-proof at the mating end 132. Thus, the connector housing 106 can extend beyond the mating ends 132 of the electrical contacts 108 along the mating direction M.

Figure 4A:
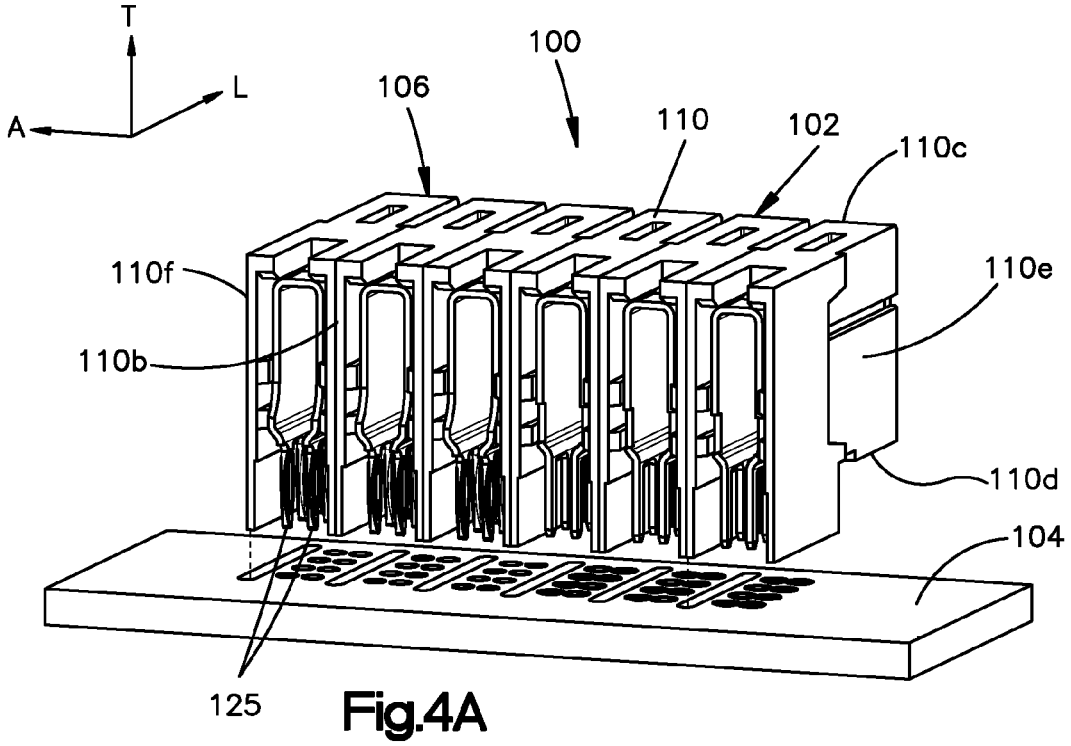
FIGS. 4A-B are perspective views of the electrical connector shown in FIG. 2A, wherein the electrical connector is aligned to be mounted to the underlying substrate.
Figure 4B:
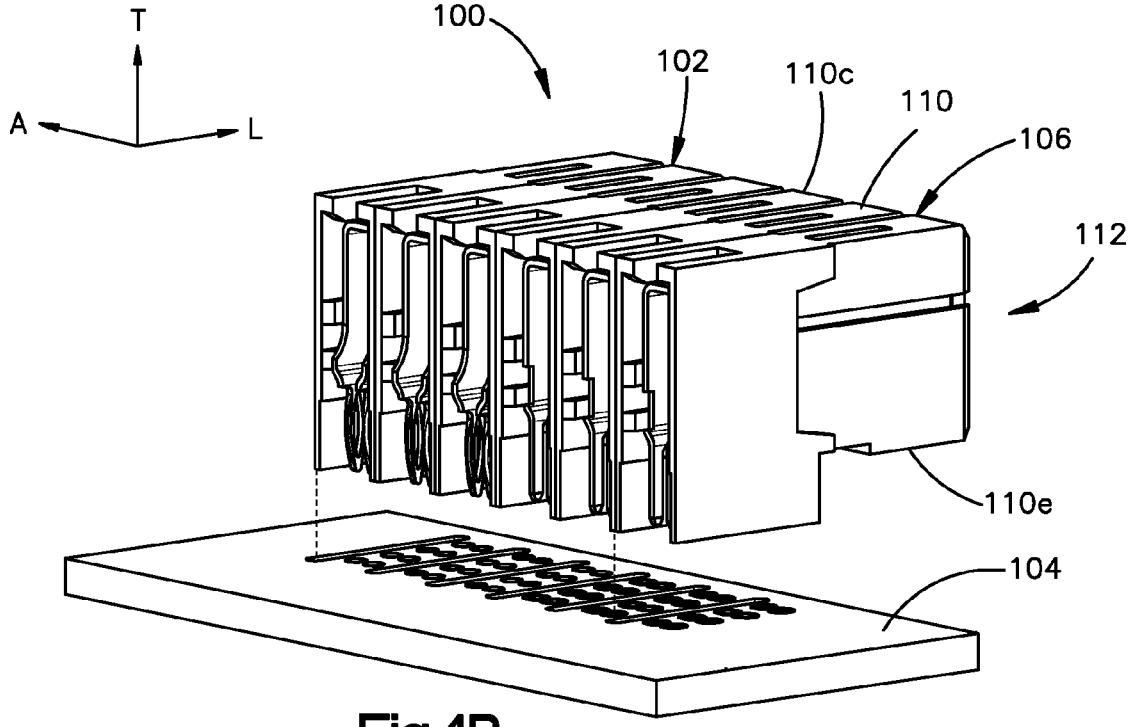

With particular reference to FIGS. 4A-B, the connector housing 106, and thus the electrical connector 102, can include at least one electrically insulative fin, for instance a plurality of electrically insulative fins 156 that are supported by the housing body 110. It will be understood that the fins 156 can be monolithic with the housing body 110 or attached to the housing body 110 as desired. Each fin 156 can be disposed between the electrical contacts 108 along the lateral direction A. For instance, at least one fin 156 can be disposed between at least first and second electrical contacts 108 of the plurality of electrical contacts along the lateral direction A. At least one fin, for instance each fin 156, can extend downward with respect to the mounting portions 120, and in particular the mounting ends 134, such that the mounting ends 134 are touch proof and the at least one fin 156 is received by the substrate 104 before the mounting portions are received by the substrate 104 when the electrical connector 102 is mounted to the substrate 104. Thus, the electrical contacts 108 can be touch proof at the mating ends 132 and the mounting ends 134 in accordance with the IEC 60950 test procedure. The fins 156 can connect to the bottom end 110*d* of the housing body 110. Thus, the mating ends 132 and the mountings ends 134 can be touch-proof such that the mating ends 132 and the mounting ends 136 cannot be touched by a test finger, which represents a human finger, from every reasonable position.

Thus, the electrical contacts 108 can include first and second electrical contacts 108 that are supported by the connector housing 106 and spaced apart from each other along the lateral direction that is substantially perpendicular with respect to the longitudinal and transverse directions L and T, respectively. Each of the first and second electrical contacts 108 can define at least one mounting terminal 124 that is placed in electrical communication with the substrate 104 when the first and second electrical contacts 108 are mounted to the substrate 104. Further, the connector housing 106 can define the electrically insulative fin 156 that can be disposed between the first and second electrical contacts 108 along the lateral direction A. Thus, the fin 156 can define a maximum height of the electrical connector 102 along the transverse direction T. For instance, the bottom end 110*d* can be spaced from the top end 110*c* in a downward direction that is substantially parallel to the transverse direction T, and the mounting terminals 124 can terminate at the mounting end 134 along the downward direction and the fin 156 can terminate at a location that is spaced from the mounting end 134 in the downward direction. Thus, the fin 156 can extend through the slot 148 in the substrate 104 in the downward direction when the electrical connector 102 is mounted to the substrate 104.

Figure 2A:
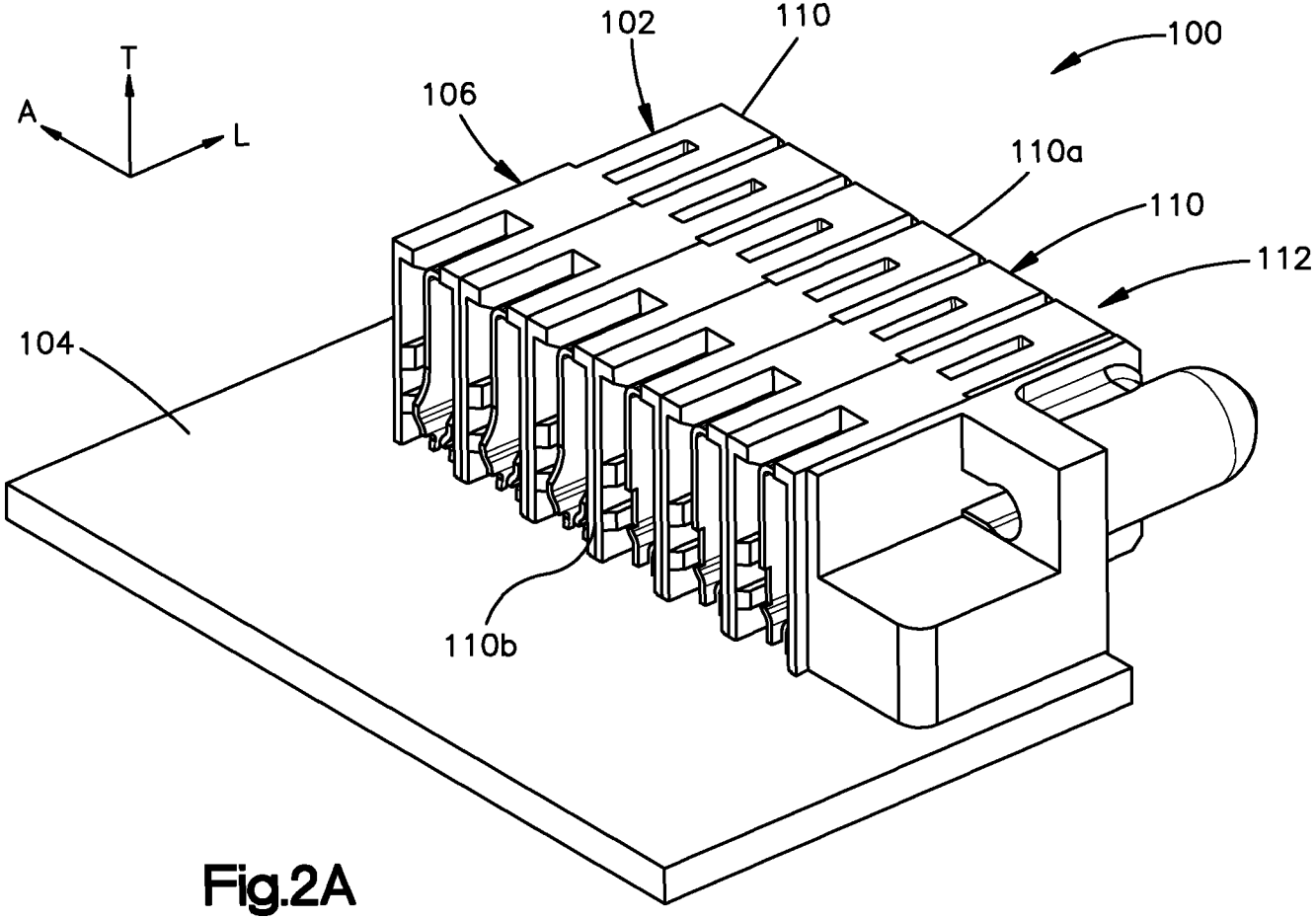
FIG. 2A is a perspective view of the electrical connector assembly shown in FIG. 1, wherein the electrical connector includes a connector housing and a plurality of electrical contacts that are at least partially disposed within the connector housing.
Figure 2B:
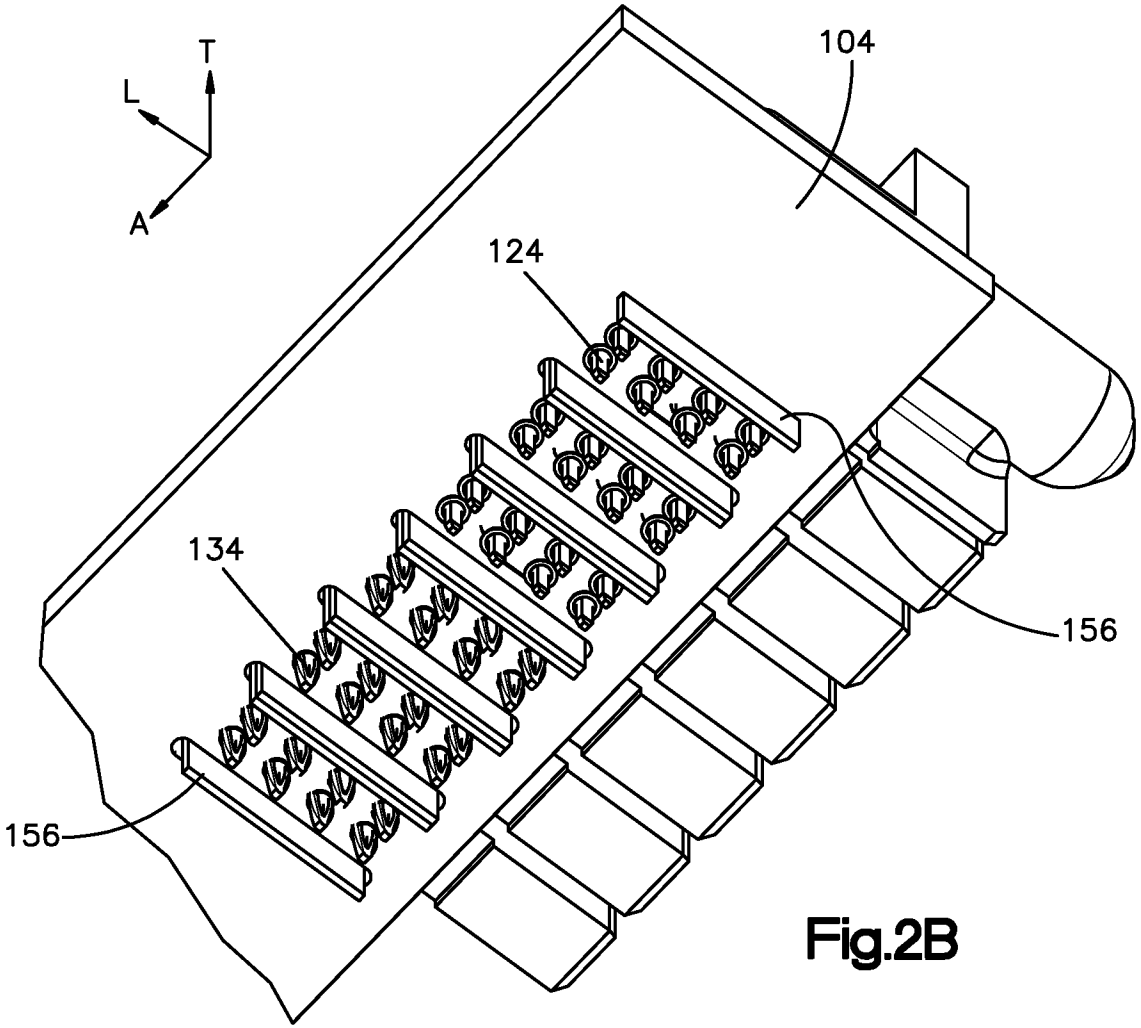
FIGS. 2B-C are other perspective views of the electrical connector assembly shown in FIG. 1.
Figure 2C:
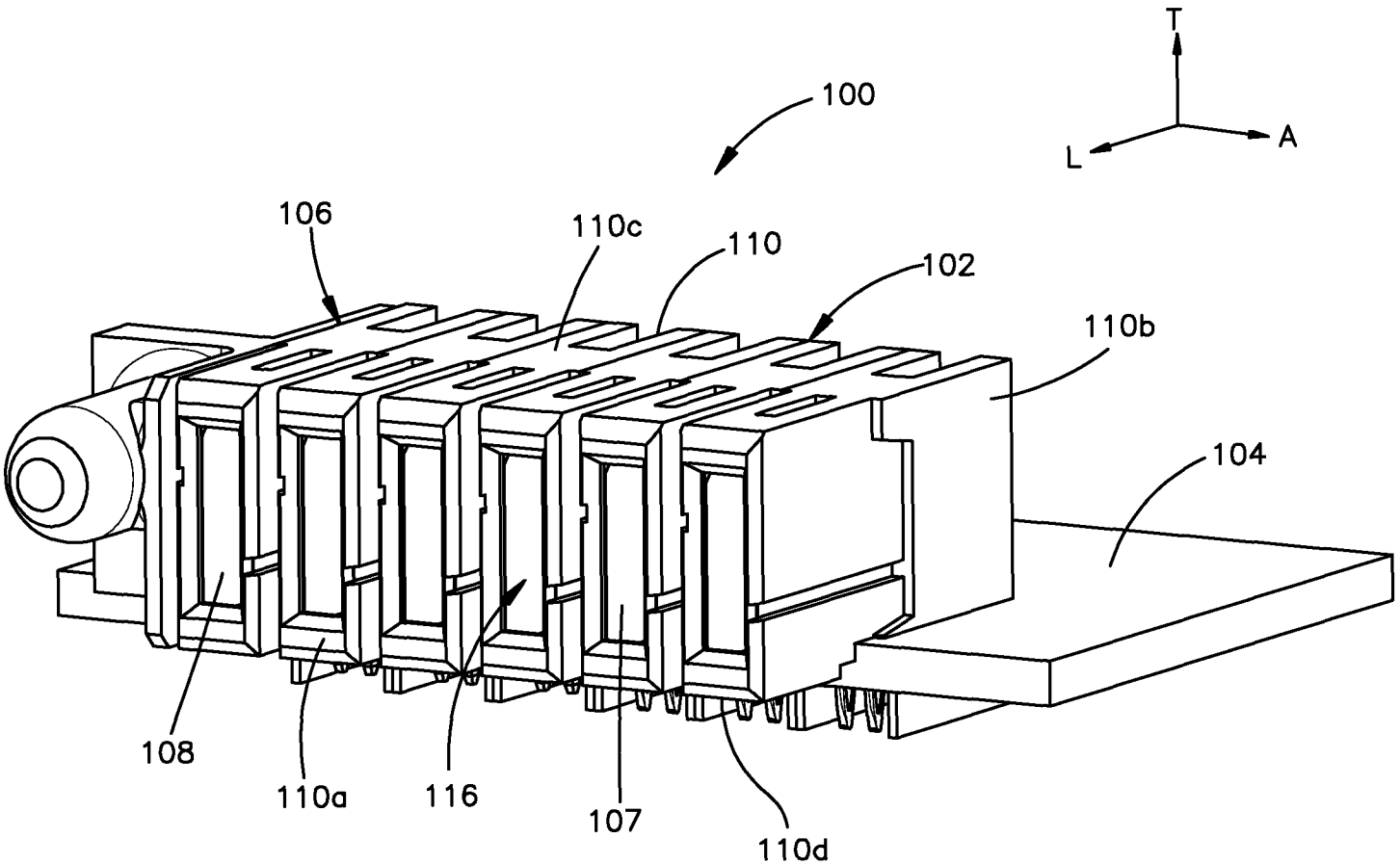
Figure 2D:
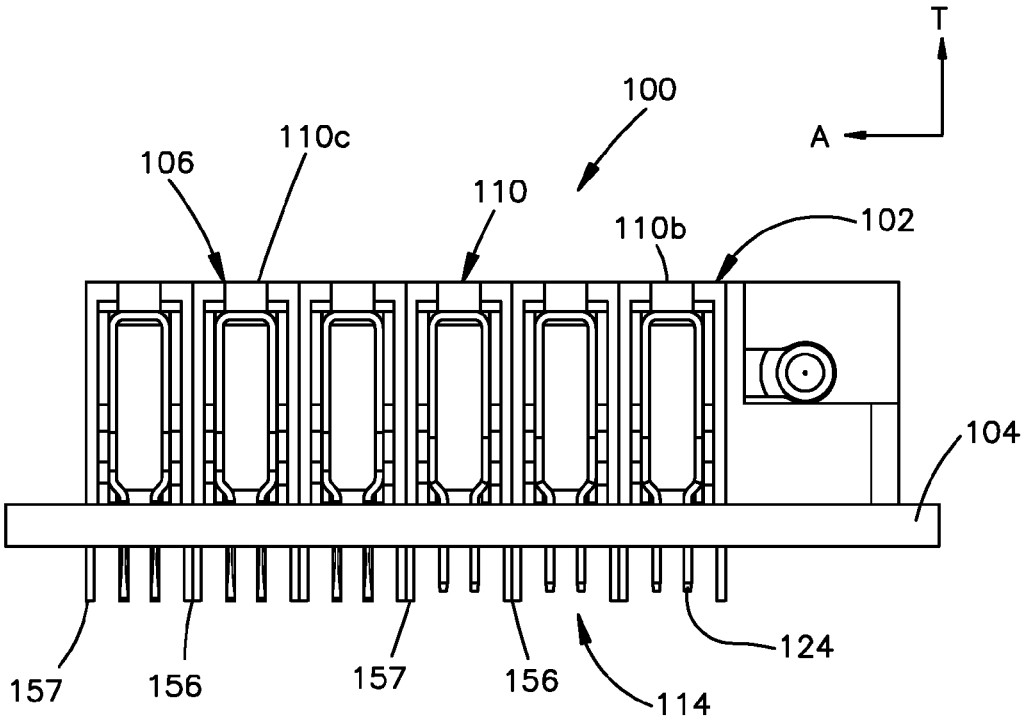
FIG. 2D is a rear elevation view of the electrical connector assembly shown in FIG. 1.

Further, in accordance with the illustrated embodiment, referring particularly to FIG. 2D, the mounting portion 120 of each of the first and second electrical contacts 108 can terminate at the mounting end 134 that is spaced from the housing body 110 a first distance $d_1$ along the transverse direction T that is perpendicular to each of the mating direction M and the lateral direction A. The at least one fin 156 can extend from the housing body 110 along the transverse direction T and terminate at a distal end 157 that is spaced from the housing body a second distance $d_2$ along the transverse direction T, wherein the second distance $d_2$ is no less than the first distance $d_1$. For instance, the second distance $d_2$ can be greater than the first distance $d_1$. Thus, the fin 156 can be configured to be inserted at least into, for instance through, the substrate 104 before the mounting portions 120 are inserted at least into, for instance through, the substrate 104 when the electrical connector 102 is mounted to the substrate 104. Thus, the connector housing 106 can define an electrically insulative fin 156 that extends down from the housing body 110 past the mounting ends 134 along the transverse direction T, and the fin 156 can define a first dimension in the longitudinal direction L and a second dimension in a lateral direction A that is perpendicular to each of the longitudinal direction L and the transverse direction T, and the first dimension can be least five times greater than the second dimension. For instance, The fin 156 can be longer in a major direction that includes at least one of the longitudinal direction L and the lateral direction A with respect to a minor direction that is perpendicular to the major direction and does not include the transverse direction T. For instance, the major direction can include each of the longitudinal direction L and the lateral direction A. Thus, the fin 156 can be longer in one of the longitudinal and the lateral directions L and A than the other of the longitudinal direction L and the lateral direction A. Further, the fin 156 can define a first dimension in the one of the longitudinal and the lateral directions L and A, and a second dimension in the other of the longitudinal and the lateral directions L and A, and the first dimension can be least five times greater than the second dimension. In accordance with the illustrated embodiment, the first dimension is in the longitudinal direction L. Alternatively, it will be understood that the first dimension can be the lateral direction.

Figure 6:
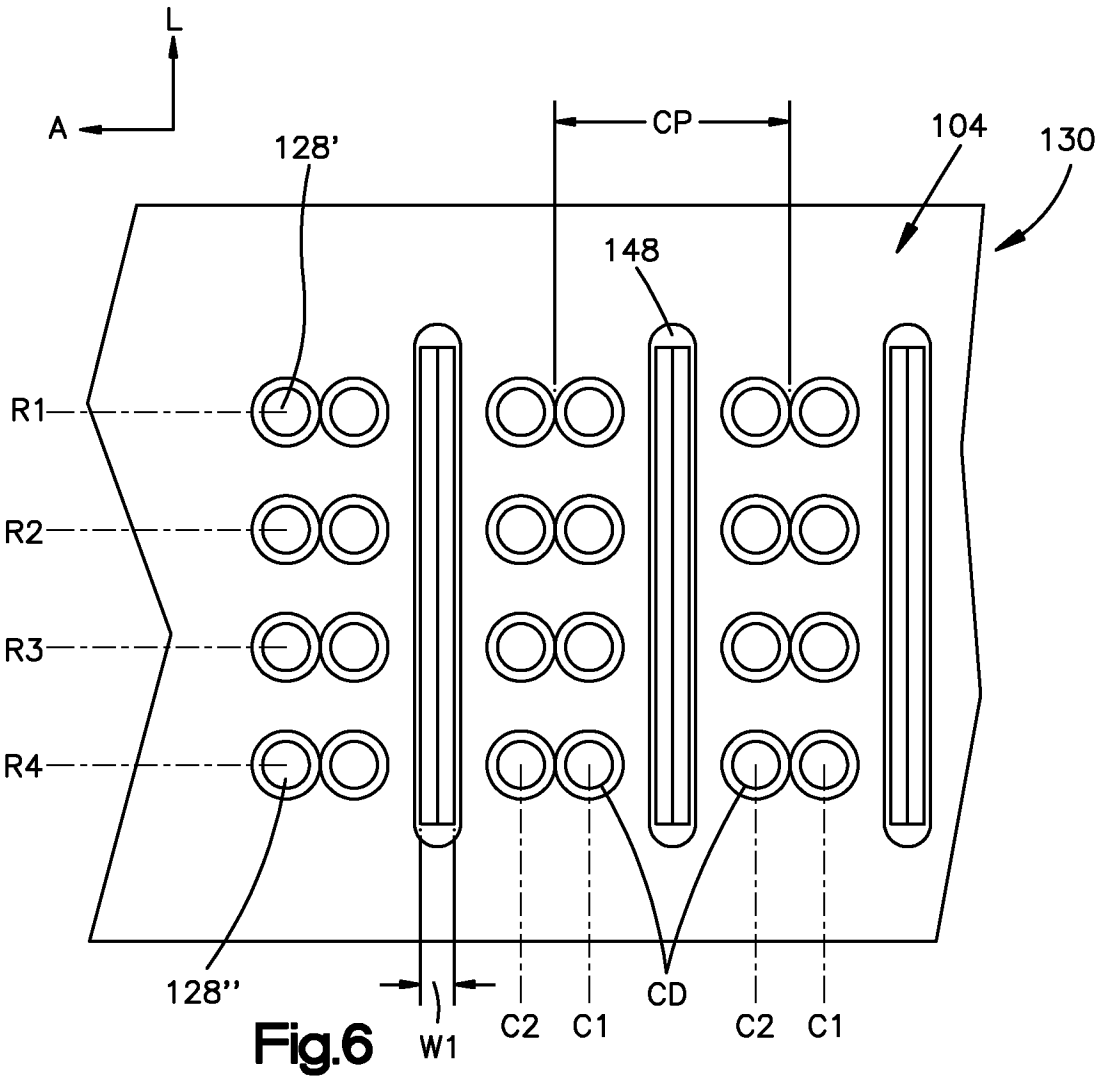
FIG. 6 is the bottom plan view of the portion of the underlying substrate show in FIG. 2A, wherein only the connector housing of FIG. 2A is mounted to the substrate.
Figure 7A:
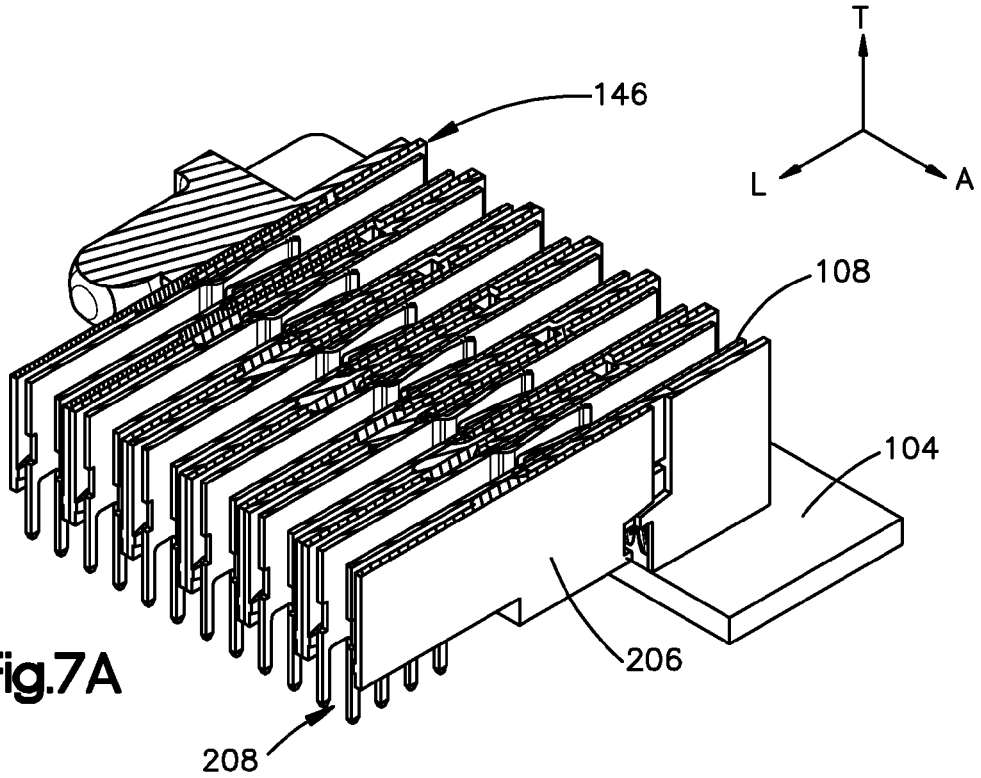
FIG. 7A is a cross-section of a perspective view the electrical connector system shown in FIG. 1A, wherein the electrical connector assembly is mated with the complementary electrical connector.
Figure 7B:
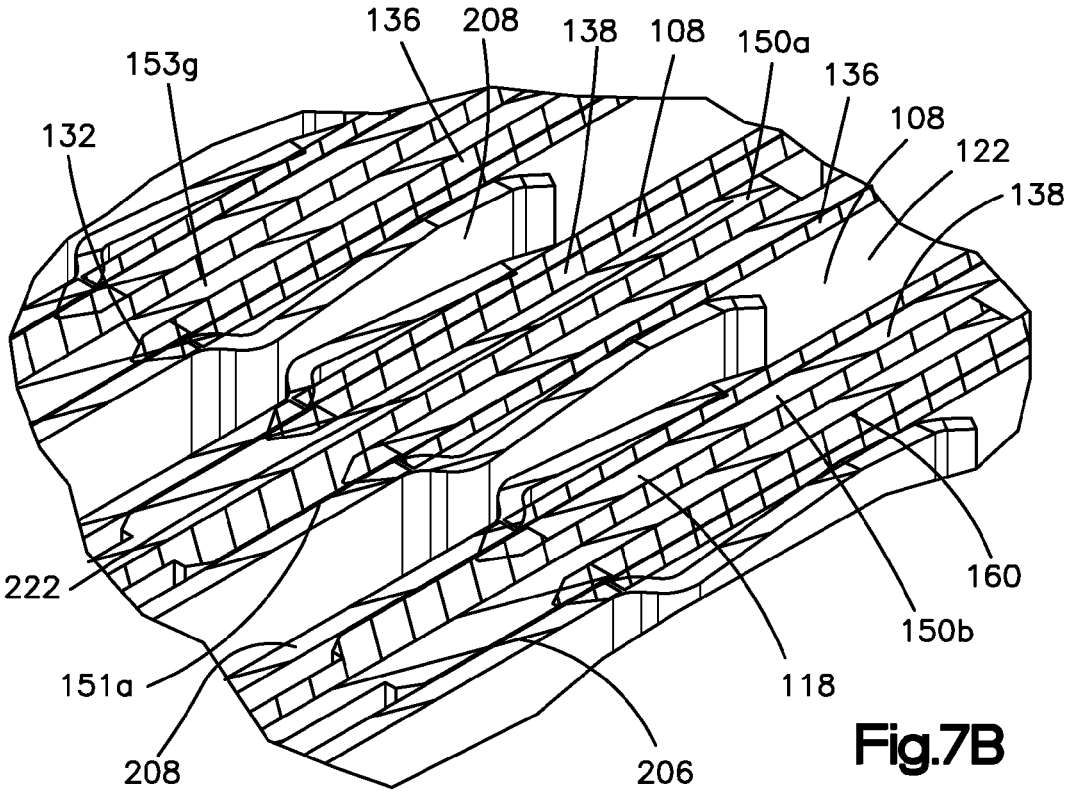
FIG. 7B is an isolated view of a portion of FIG. 7A.
Figure 8A:
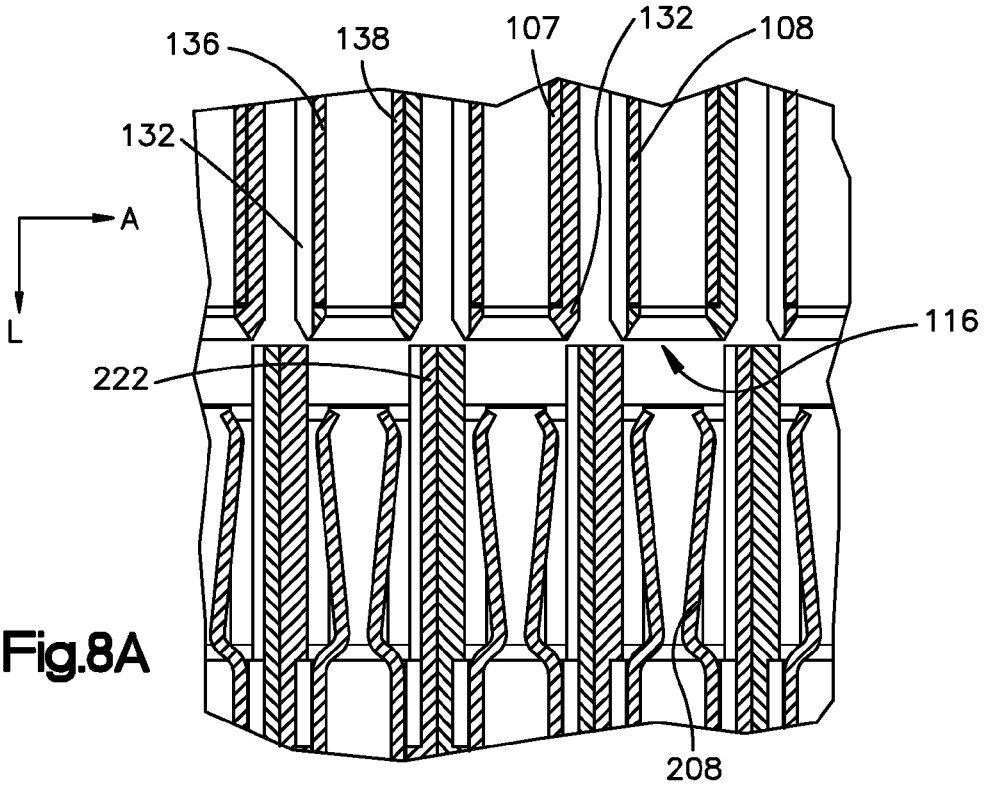
FIG. 8A is a cross-section of a top plan view of the electrical connector shown in FIG. 1A aligned for mating with the complementary electrical connector shown in FIG. 1A.
Figure 8B:
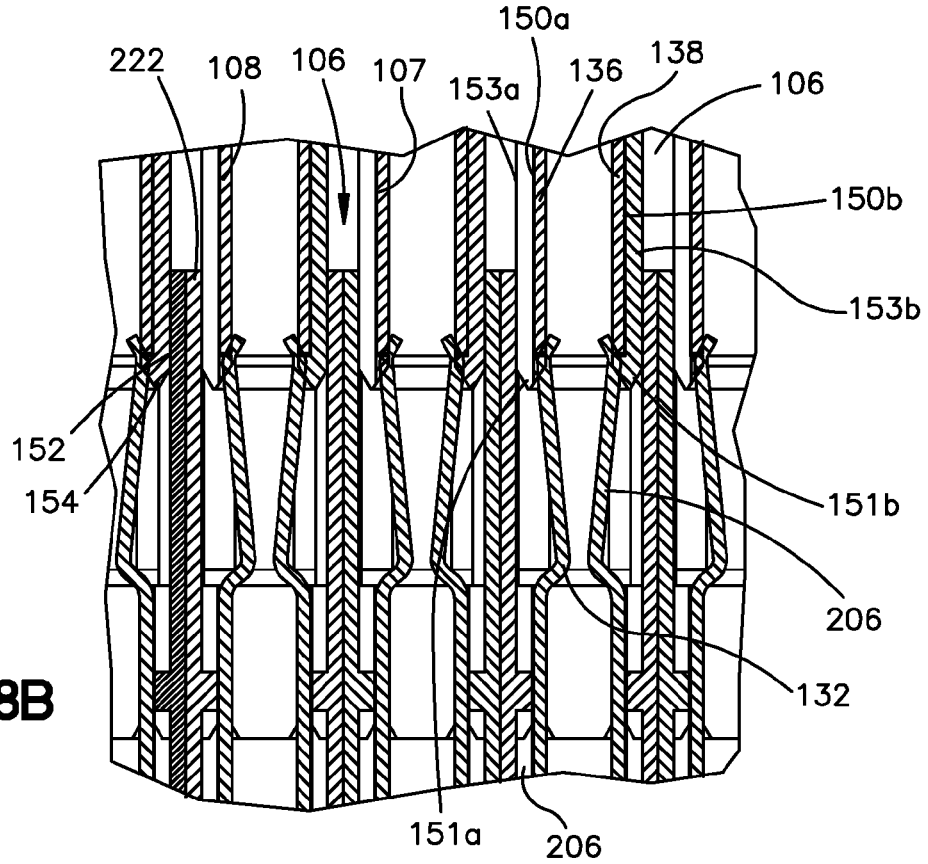
FIG. 8B is a cross-section of a top plan view of the electrical connector shown in FIG. 1A mated with the complementary electrical connector shown in FIG. 1A.

Referring to FIG. 6, the fins 156 define a fin width $W_1$ along the lateral direction A that is less than a width of a slot 148 of the substrate 104 such that that the slot 148, and thus the substrate 104, can receive the fin 156 such that the fin 156 can extend through the substrate 104. The plurality of electrical contacts 108 can define pairs of electrical contacts 108 such that each pair of electrical contacts 108 includes a first electrical contact and a second electrical contact disposed immediately adjacent the first electrical contact along the lateral direction A such that no other electrical contact is disposed between the first and second electrical contacts. Thus, in accordance with the illustrated embodiment, only a single fin 156 can be disposed between each pair of electrical contacts along the lateral direction A. It will be understood that the number of fins disposed between a pair of immediately adjacent electrical contacts 108 can vary as desired. For instance, the fin 156 can be disposed between first and second ones of immediately adjacent electrical contacts along the lateral direction A, wherein no other ones of the electrical contacts 108 are disposed between the immediately adjacent electrical contacts 108 along the lateral direction A.

Figure 5:
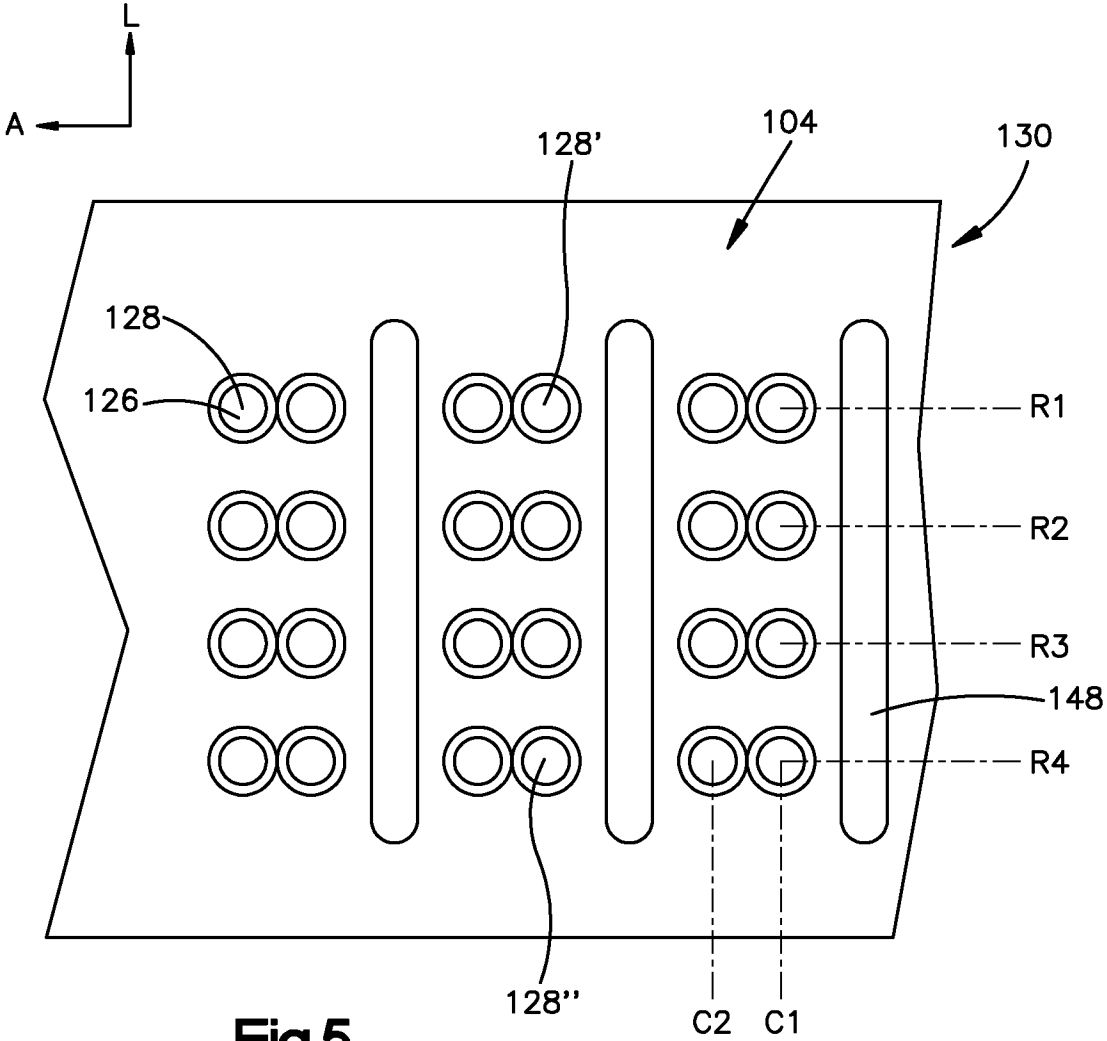
FIG. 5 is a bottom plan view of the a portion of underlying substrate shown in FIG. 2A.

Referring to FIGS. 5-6, the substrate 104 can include a plurality of mounting locations 128, which can be provided as plated through holes 126 and the slots 148. The plated through holes 126 can be configured to receive the mounting terminals 124 of the electrical contacts 108 as described above. The slots 148 can be configured to receive a portion of the connector housing 106, for instance the fins 156. The mounting terminals can define any geometrical cross-sectional shape as desired. Further, the fins 156 can define any geometrical cross-sectional shape as desired.

The mounting terminals 124 of the electrical contacts 108 defines a footprint 130 taken from a portion of a bottom plan view of the electrical connector 102. The illustrated footprint 130 is illustrated as including three electrical contacts 108, though any number of electrical contacts 108 can be provided as desired. The mounting terminals 124 of the electrical contacts 108 are arranged in a plurality of columns. For instance, the first mounting terminals 124*a* of each electrical contact 108 are arranged in a first column (column 1) of the respective contact 108, and the second mounting terminals 124*b* of each electrical contact 108 are arranged in a second column (column 2) of the respective contact 108. Columns 1 and 2 of each electrical contact 108 are disposed laterally adjacent each other and extend along a direction, for instance the longitudinal direction L, that is substantially parallel to each other. The electrical contacts 108 are further arranged such that the first column ($C_1$) of one electrical contact 108 is disposed laterally adjacent to the second column ($C_2$) of its adjacent electrical contact 108, and the fin 156 is disposed between the first column ($C_1$) of one electrical contact 108 and the second column ($C_2$) of its adjacent electrical contact 108.

Each electrical contact 108 can define a centerline disposed at the midpoint between the first and second side walls 136 and 138 along the lateral direction A. The spacing between the centerlines of adjacent electrical contacts 108 may be referred to as the column pitch CP. The first and second columns can define a centerline disposed at the midpoint between the first and second columns along the lateral direction A. The spacing between the centerlines of adjacent column midpoints may be substantially equal to the column pitch CP. In the illustrated embodiment, the column pitch CP can be between 1 and 7 mm, such as between 5 and 6 mm, such as between, for instance approximately 5.0 mm or more particularly 5.08 mm. It should be further appreciated the electrical contacts 108 can be arranged and constructed so as to define any column pitch as desired.

One or more, up to all as illustrated in FIGS. 5-6, of the first and second mounting terminals 124*a* and 124*b* of each electrical contact 108 are aligned with the respective like terminals 124*a* and 124*b* of the electrical contacts 108, arranged in rows $R_1$-$R_4$. A first or upper mounting location 128' is disposed in a first ($R_1$), and a second or lower mounting location 128" is disposed in a fourth row ($R_4$). In accordance with illustrated embodiment, the slots 148 define a distance along the longitudinal direction that is greater than the distance along the longitudinal direction L between the uppermost surface of the upper mounting location 128' and lowermost surface of the lower mounting location 128". Thus, as illustrated the fins 156 can define a length along the longitudinal direction L that is greater than the distance between a mounting terminal in row 1 and a mounting terminal in row 4 along the longitudinal direction L. Thus, the fins 156 can increase a creepage distance CD (see FIG. 6) as desired. The fins 156 can increase the creepage distance CD as compared to electrical connectors that do not include fin. For instance, in one embodiment, the creepage distance CD can be between 4 mm and 8 mm, for instance 4.91 mm. It should be further appreciated that the fins 156 can be constructed so as to define any creepage distance CD as desired.

Thus, the mounting terminals 124*a* and 124*b* of adjacent columns 1 and 2 of adjacent electrical contacts 108 are spaced apart a greater creepage distance than if there is no slot 148 disposed between them along the lateral direction A. Thus, the illustrated connector 102 provides increased creepage distance between the mounting terminals without increasing the footprint of the mounting interface of the connector with respect to a similarly constructed connector that does not include the fins 156.

It should further be appreciated that the increased creepage distance between the mounting terminals 124*a* and 124*b* allows the electrical contacts 108 to carry an increased working voltage (for instance 400V or greater) with respect to conventional terminals, while at the same time reducing or preventing arcing across the mounting terminals 124*a* and 124*b* during operation. The electrical contacts 108 can further carry greater current than other contacts, and the electrical contacts 108 are configured to be touch-proof.

Stated yet another way, the electrical connector 102 can include an electrical housing 106 and a first electrical contact 108 comprising a first mating end 132 and a plurality of first mounting terminals 124 each having a respective first mounting end 134. The second electrical contact 108 can be positioned immediately adjacent to the first electrical contact 108, the second electrical contact 108 comprising a second mating end 132 and a plurality of second mounting terminals 124 each having a respective second mounting end 134. The first mounting ends 134 of the first mounting terminals 124 can configured to extend from the substrate 104 and remain exposed, and the second mounting terminals 134 can configured to extend from the substrate 104 and remain exposed. Further, the electrical connector 102 can be touch proof as described above, for instance touch proof according to the IEC 60950 test finger probe procedure, at the first mating end 132, at the second mating end 132, at the first mounting end 134 of each of the first mounting terminals 124, and at the second mounting end 134 of each of the second mounting terminals 124. The electrical housing 106 can further comprise an electrically insulative fin 156 positioned between the first mounting terminals 124 and the second mounting terminals 124 and the electrically insulative fin 156 can extend in a length beyond the first mounting ends 134 of the first mounting terminals 124 and the second mounting ends 134 of the second mounting terminals 124. The electrical housing 106 can extend beyond the first mating end 132 of the first electrical contact 108 and the second mating end 132 of the second electrical contact 108.

Figure 9:
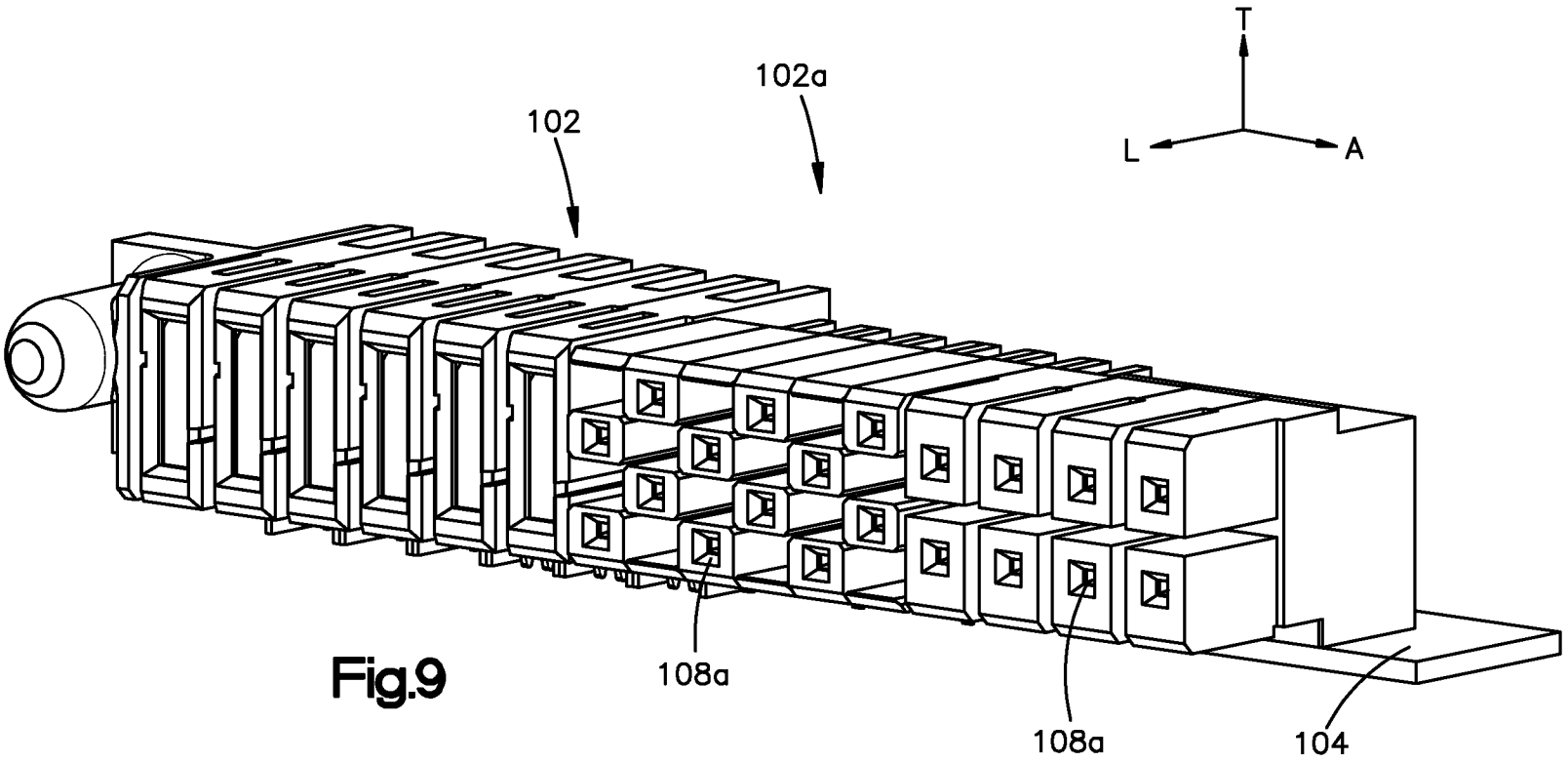
FIG. 9 is a perspective view of the electrical connector shown in FIG. 2A including signal contacts in accordance with another embodiment.
Figure 10A:
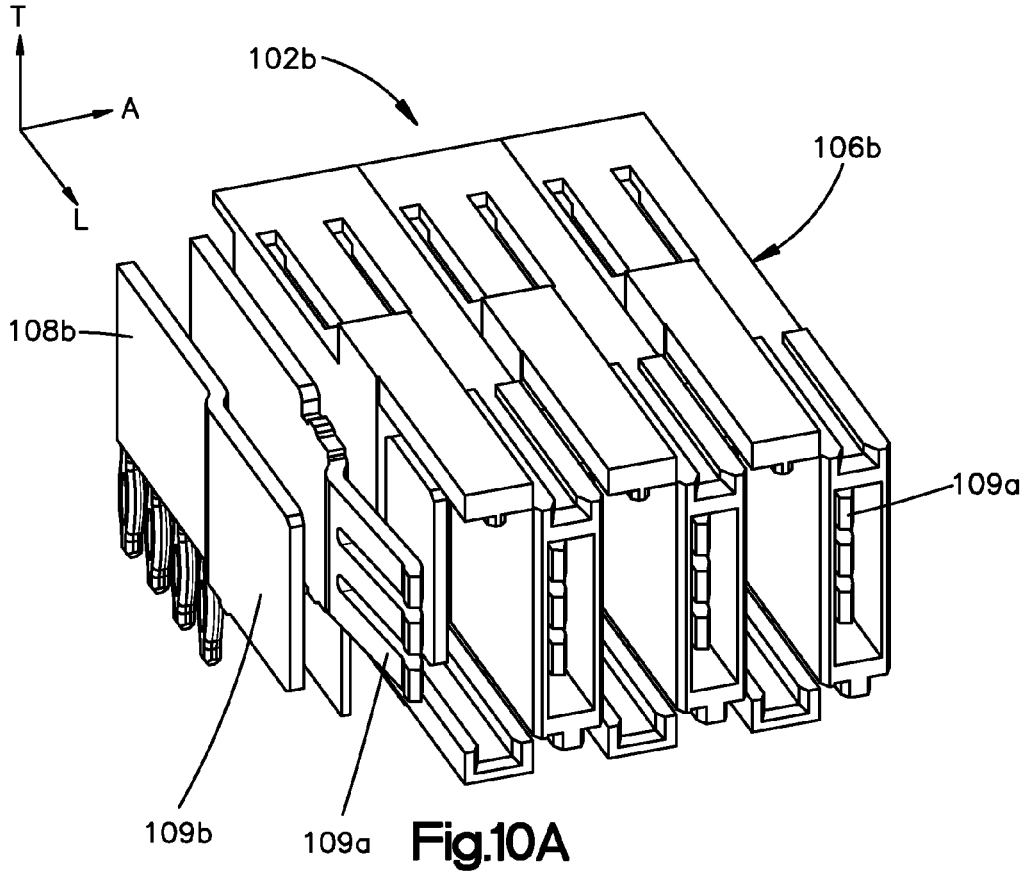
FIG. 10A is a perspective view of a gender-neutral electrical connector constructed in accordance with yet another embodiment.
Figure 10B:
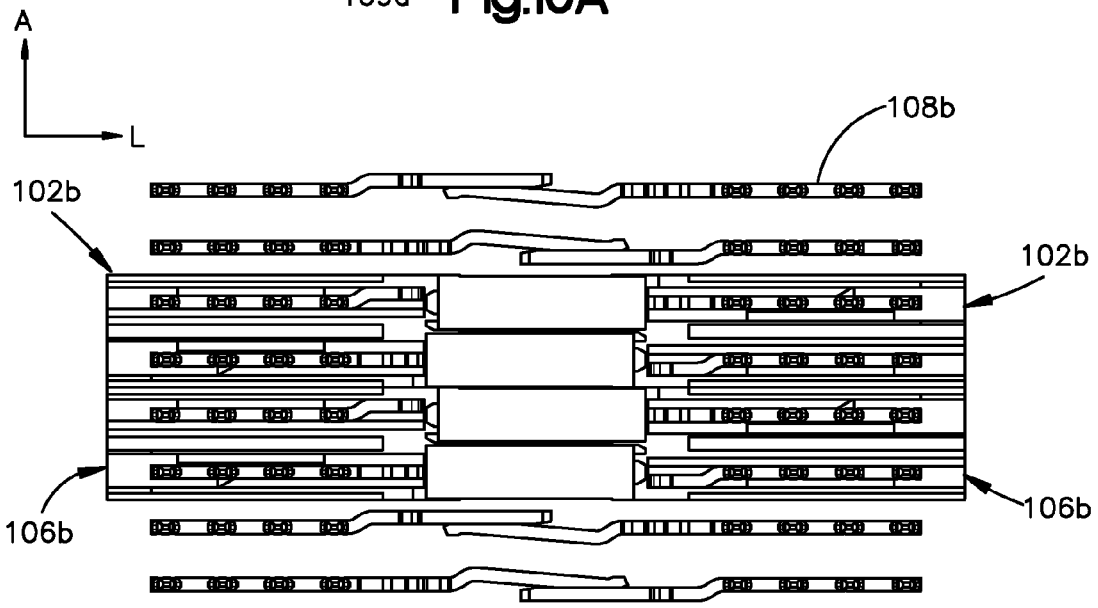
FIG. 10B is bottom plan view of the gender-neutral electrical connector shown in FIG. 10A mated with a complementary gender neutral electrical connector.

Referring to FIG. 9, an electrical connector 102*a* includes the electrical connector 102 signal contacts 108*a* that are configured to transmit data. The signal contacts 108*a* can be touch proof. Further, referring to FIGS. 10A and 10B, it will be understood that the electrical connector 102 can be configured as a gender-neutral electrical connector 102*b* in accordance with an embodiment. Referring to FIG. 10, the gender-neutral electrical connector 102*b* includes electrical contacts 108*b* that alternate between a receptacle electrical contact 109*a* and a header or plug receptacle contact 109*b* along the lateral direction A such that mating forces along the mating direction M, which can be parallel with the longitudinal direction L, are substantially balanced. Each of the receptacle and header electrical contacts 109*a* and 109*b* are configured as touch-proof. Further, the gender-neutral electrical connector 102*b* can be configured such that no power contacts touch the housing 106*b* of the electrical connector 102*b*.

In operation, a method of establishing an electrical connection with an electrical connector that has 1) a connector housing including a housing body and a fin that extends out from the housing body, the housing body defining a mating interface configured to mate with a complementary connector housing of a complementary electrical connector, and a mounting interface configured to be mounted onto a substrate, and 2) a plurality of electrical contacts supported by the connector housing, each of the electrical contacts defining a mounting portion and a mating portion, can include the bringing the connector housing toward the substrate. During the bringing step, the fin can be inserted at least into a slot in the substrate. After the inserting step and during the bringing step, the mounting portion can be inserted into the substrate so as to place the electrical contacts in electrical communication with the substrate. A relative movement between the electrical connector and the complementary electrical connector can be established along the mating direction so as to cause the mating portions of the electrical contacts to mate with complementary electrical contacts of the complementary electrical connector. The complementary connector housing can be received in a gap that extends into the housing body.

In accordance with one embodiment and in accordance with the description above, a method can include offering for sale a first electrical connector, for instance the electrical connector 102, that includes at least one electrically insulative fin, for instance a plurality of electrically insulative fins 156.

The embodiments described in connection with the illustrated embodiments have been presented by way of illustration, and the present invention is therefore not intended to be limited to the disclosed embodiments. Furthermore, the structure and features of each the embodiments described above can be applied to the other embodiments described herein, unless otherwise indicated. Accordingly, the invention is intended to encompass all modifications and alternative arrangements included within the spirit and scope of the invention, for instance as set forth by the appended claims.

What is claimed:

1. An electrical connector comprising:

a dielectric connector housing including a housing body that defines a mounting interface configured to be mounted onto a substrate and a mating interface configured to mate with at least one complementary electrical connector along a mating direction;

a plurality of electrical contacts supported by the connector housing and spaced apart from each other along a lateral direction that is substantially perpendicular to the mating direction, the electrical contacts including 1) a mating portion configured to mate with a complementary electrical contact of the at least one complementary electrical connector when the connector housing is mated with the at least one complementary electrical connector, and 2) a mounting portion configured to electrically connect to the substrate when the connector housing is mounted onto the substrate;

at least one electrically insulative fin supported by the housing body, the at least one fin disposed between at least first and second electrical contacts of the plurality of electrical contacts along the lateral direction, wherein 1) the mounting portion of each of the first and second electrical contacts terminates at a mounting end that is spaced from the housing body a first distance along the transverse direction that is perpendicular to each of the mating direction and the lateral direction, 2) the at least one fin extends from the housing body along the transverse direction and terminates at a distal end that is spaced from the housing body a second distance along the transverse direction, and 3) the second distance is no less than the first distance.

2. The electrical connector as recited in claim 1, wherein the second distance is greater than the first distance.

3. The electrical connector as recited in claim 2, wherein the at least one fin is configured to be inserted at least into the substrate before the mounting portions are inserted at least into the substrate when the electrical connector is mounted to the substrate.

4. The electrical connector as recited in claim 1, wherein the at least one fin is longer in a major direction that includes at least one of the mating direction and the lateral direction with respect to a minor direction that is perpendicular to the major direction and does not include the transverse direction.

5. The electrical connector as recited in claim 4, wherein the major direction includes each of the mating direction and the lateral direction.

6. The electrical connector as recited in claim 1, wherein the at least one fin is longer in one of the mating and the lateral directions than the other of the mating direction and the lateral direction.

7. The electrical connector as recited in claim 6, wherein the at least one fin defines a first dimension in the one of the mating and the lateral directions, and a second dimension in the other of the mating and the lateral directions, and the first dimension is at least five times greater than the second dimension.

8. The electrical connector as recited in claim 7, wherein the first dimension is in the mating direction.

9. The electrical connector as recited in claim 7, wherein the first dimension is in the lateral direction.

10. The electrical connector as recited in claim 1, wherein the at least one fin is monolithic with the housing body.

11. The electrical connector as recited claim 1, wherein the at least one fin is attached to the housing body.

12. The electrical connector as recited in claim 1, the electrical connector further comprising at least one electrically insulative arm supported by the housing body, the at least one arm extending beyond the mating portions in the mating direction such that the mating portions terminate at a location along the mating direction that is disposed inward with respect to a location in which the arm terminates along the mating direction.

13. The electrical connector as recited in claim 1, wherein the plurality of electrical contacts define pairs of electrical contacts, each pair of electrical contacts including a first electrical contact and a second electrical contact disposed immediately adjacent the first electrical contact such that no other electrical contact is disposed between the first and second electrical contacts.

14. The electrical connector as recited in claim 13, wherein a single fin is disposed between each pair of electrical contacts along the lateral direction.

15. The electrical connector as recited in claim 1, wherein each of the electrical contacts comprise 1) first and second side walls spaced apart from each other along the lateral direction to define a first distance, 2) first and second pluralities of mounting terminals spaced apart from each along the lateral direction to define a second distance that is less than the first distance, 3) a first neck that extends between the first side wall and the first plurality of mounting terminals, and 4) a second neck that extends between the second side wall and the second plurality of mounting terminals.

16. The electrical connector as recited in claim 1, wherein the electrical connector is a power connector.

17. An electrical connector configured to mate with at least one complementary electrical connector, and further configured to mount to a substrate along a mounting direction, the electrical connector comprising:

an electrically insulative connector housing including a housing body that defines a front end, a rear end opposite the front end along a longitudinal direction, a top end that extends from the front end to a rear end, and a bottom end spaced from the top end along a transverse direction that is perpendicular with respect to the longitudinal direction, the bottom end defining a mounting interface that is configured to be mounted onto the substrate;

a plurality of electrical contacts supported by the connector housing, each of the electrical contacts defining at least one mounting end that extends down from the connector housing along the transverse direction, wherein 1) the connector housing defines a electrically insulative fin that extends down from the housing body past the mounting ends along the transverse direction, and 2) the fin defines a first dimension in the longitudinal direction and a second dimension in a lateral direction that is perpendicular to each of the longitudinal direction and the transverse direction, and the first dimension is at least five times greater than the second dimension.

18. The electrical connector as recited in claim 17, wherein the fin is disposed between first and second ones of immediately adjacent electrical contacts along the lateral direction, and no other ones of the electrical contacts are disposed between the immediately adjacent electrical contacts along the lateral direction.

19. The electrical connector as recited in claim 17, wherein the connector housing includes an inner surface that defines at least one opening such that at least one of the plurality of electrical contacts are disposed in the opening, the inner surface at least substantially surrounds the at least one of the plurality of electrical contacts, and the inner surface extends out from the housing body along the mating direction past a mating end of the at least one of the plurality of electrical contacts, the at least one of the electrical contacts terminating at the mating end.

20. The electrical connector as recited in claim 19, wherein the bottom end is spaced from the top end in a downward direction that is along transverse direction, and wherein the electrical contact further terminates at the mounting end along the downward direction and the fin terminates at a location that is spaced from the mounting end along the downward direction.

21. The electrical connector as recited in claim 17, wherein the fin extends through a slot in the substrate in the downward direction when the electrical connector is mounted to the substrate.

22. A method of establishing an electrical connection with an electrical connector that has 1) a connector housing including a housing body and a fin that extends out from the housing body, the housing body defining a mating interface configured to mate with a complementary connector housing of a complementary electrical connector, and a mounting interface configured to be mounted onto a substrate, and 2) a plurality of electrical contacts supported by the connector housing, each of the electrical contacts defining a mounting portion and a mating portion, the method comprising the steps of:

bringing the connector housing toward the substrate;

during the bringing step, inserting the fin at least into a slot in the substrate; and after the inserting step and during the bringing step, inserting the mounting portion into the substrate so as to place the electrical contacts in electrical communication with the substrate.

23. The method as recited in claim 22, the method further comprising the step of establishing a relative movement between the electrical connector and the complementary electrical connector along a mating direction so as to cause the mating portions of the electrical contacts to mate with complementary electrical contacts of the complementary electrical connector.

24. The method as recited in claim 22, the method further comprising the step of receiving the complementary connector housing in a gap that extends into the housing body.

* * * * *